US011445821B2

(12) United States Patent
Sagel

(10) Patent No.: US 11,445,821 B2
(45) Date of Patent: Sep. 20, 2022

(54) LAZY SUSAN FITTING FOR A CORNER CABINET

(71) Applicant: Vauth-Sagel Holding GmbH & Co. KG, Brakel (DE)

(72) Inventor: Peter Sagel, Paderborn (DE)

(73) Assignee: VAUTH-SAGEL HOLDING GMBH & CO. KG, Brakel (DE)

( * ) Notice: Subject to any disclaimer, the term of this patent is extended or adjusted under 35 U.S.C. 154(b) by 0 days.

(21) Appl. No.: 17/130,026

(22) Filed: Dec. 22, 2020

(65) Prior Publication Data

US 2022/0192372 A1 Jun. 23, 2022

(51) Int. Cl.
*A47B 49/00* (2006.01)

(52) U.S. Cl.
CPC ..... *A47B 49/006* (2013.01); *A47B 2230/07* (2013.01)

(58) Field of Classification Search
CPC ..... A47B 49/006
USPC ..... 312/238
See application file for complete search history.

(56) References Cited

U.S. PATENT DOCUMENTS 2,777,585 A * 1/1957 Roberta ..... A47B 49/006 211/144
3,019,912 A * 2/1962 Alfred ..... A47B 49/006 211/144
3,982,800 A * 9/1976 Gorton ..... A47B 49/006 312/238
4,181,037 A * 1/1980 Boon ..... A47B 49/006 312/238
4,433,885 A 2/1984 Baker
4,587,908 A * 5/1986 DeBruyn ..... A47B 49/006 108/142
4,693,188 A * 9/1987 Twellmann ..... A47B 49/006 108/183
5,312,003 A * 5/1994 Domenig ..... A47B 49/004 211/144
6,017,108 A 1/2000 Domenig
6,991,305 B2 * 1/2006 Gallea ..... A47B 49/006 312/238
7,922,016 B1 * 4/2011 Domenig ..... A47B 57/20 211/144
8,210,373 B2 * 7/2012 Liao ..... A47B 87/0246 211/144
8,356,953 B2 * 1/2013 Sagel ..... A47B 49/004 211/144
8,459,474 B2 6/2013 Sagel
(Continued)

*Primary Examiner* — James O Hansen
(74) *Attorney, Agent, or Firm* — Thomas | Horstemeyer, LLP

(57) ABSTRACT

A lazy susan fitting for a cabinet having a top wall and a bottom wall has a supporting column of constant length, a top mount, a bottom mount, and a shelf supported at the supporting column. The top mount and a top end of the supporting column are configured to allow for mounting the supporting column to the top mount fixed to the top wall by moving the supporting column tilted out of the vertical in the top mount from below beyond a final installation position, and for aligning the supporting column in the top mount to the vertical. The bottom mount and the bottom end of the supporting column are configured for mounting the supporting column to the bottom mount fixed to the bottom wall by inserting the supporting column aligned to the vertical into the bottom mount from above.

14 Claims, 22 Drawing Sheets

(56) References Cited

U.S. PATENT DOCUMENTS

| | | | | |
|---|---|---|---|---|
| 9,265,342 | B2 | 2/2016 | Sagel | |
| 2005/0194873 | A1 * | 9/2005 | Hoffman | A47B 49/006<br>312/305 |

* cited by examiner

LAZY SUSAN FITTING FOR A CORNER CABINET

FIELD OF THE INVENTION

The present invention generally relates to a lazy susan fitting for a cabinet and to a corner cabinet having a lazy susan fitting. The lazy susan fitting comprises a supporting column having a top end and a bottom end, a top mount for the top end of the supporting column, a bottom mount for the bottom end of the supporting column, at least one shelf, typically two shelves, and at least one shelf mount, typically two shelf mounts, to be mounted to the supporting column.

BACKGROUND OF THE INVENTION

U.S. Pat. No. 8,356,953 discloses a rotary fitting for a corner cupboard. The rotary fitting comprises a supporting column, fastening members for the supporting column, an article-carrying member rotating about the supporting column, and a rotary bearing between the supporting column and the article-carrying member. The fastening members include a bottom fastening member having a plurality of screw holes allowing for screwing the bottom fastening member to a floor panel of the corner cupboard. The bottom fastening member holds the bottom end of the supporting column. The supporting column is connected to the bottom fastening member to be fixed in rotation about the vertical. The top end of the supporting column is likewise fastened to the corner cupboard via a top fastening member or via a plurality of top fastening members. Mounting the rotary fitting to the corner cupboard requires fastening the bottom and top fastening members to the floor and the top panel of the corner cupboard with the supporting column already connected to the fastening members and with the article-carrying members already arranged on the supporting column. Prior to that, the supporting column, together with the bottom and top fastening members and the article-carrying members, has to be passed through an access opening of the corner cupboard. This is also a complicated affair as the access opening of a corner cupboard is of limited size.

U.S. Pat. No. 6,017,108 discloses a rotary shelf for use within a cabinet. The rotary shelf has bottom and top mounting brackets spaced apart and opposing each other attached to the bottom and the top of the inside of the cabinet. A tubular post has bottom and top ends disposed at lengthwise between the bottom and top mounting brackets. Shelves are secured to the tubular post. Post securing means include an upstanding notch plate affixed to the bottom mounting bracket and a post insert means extending into the bottom post end. The top mounting bracket includes a sleeve for inserting the top end of the post and allowing the post to rotate therein. At least the top mounting bracket has to be secured to the cabinet top with the top end of the post already inserted therein and with the shelves located on the post. Further, the shelves may only be rotated together with the post about a vertical axis defined by the mounting brackets.

U.S. Pat. No. 8,459,474 discloses a rotary fitting for a corner cupboard. The rotary fitting comprises bottom and top mounting brackets, a supporting column having a main tube and being designed to be rotary mounted to the mounting brackets such that it rotates about its longitudinal axis, and at least two pie cut-shaped shelves to be supported by the supporting column and to be fixed for rotation with the main tube. The supporting column includes a lower length adjusting assembly comprising a support element fixed in the main tube, and upper length adjusting assembly comprising a tube element partially arranged within the main tube and a clamping element releasably clamping the tube element. The bottom and top mounting brackets of this rotary fitting may be fixed to the bottom wall and the top wall of the corner cupboard prior to mounting the supporting column together with the shelves to the mounting brackets. However, the multiple part construction of the lower and upper length adjusting assemblies are complex and expensive.

U.S. Pat. No. 9,265,342 discloses a rotary fitting of a cupboard. The rotary fitting includes a rotary bearing for rotably supporting two article-carrying members at a supporting column of the rotary fitting. Further, the rotary fitting has a bottom fastening member having a plurality of screw holes allowing for screwing the bottom fastening member to a floor panel of the corner cupboard. The bottom fastening member holds a bottom end of the supporting column. The supporting column is connected to the bottom fastening member to be fixed in rotation therewith. A top end of the supporting column is likewise fastened to the corner cupboard by a top fastening member also having a plurality of screw holes. The top end of the supporting column is the top end of an inner tube slidably arranged in an outer tube of the supporting column. The article-carrying members are supported at the outer tube, only. The movability of the inner tube within the outer tube is releasably blocked by a fastening device. The telescopic arrangement of the inner tube and the outer tube of the supporting column allows for a length adjustment of the supporting column and for mounting the supporting column with the shelves arranged thereon to the bottom and top fastening members already fixed to the floor panel and the top panel of the corner cupboard. However, the telescopic arrangement and the fastening device for the inner tube render the supporting column complex and expensive. This particularly applies, as the telescopic arrangement weakens the supporting column if not manufactured very precisely.

U.S. Pat. No. 4,433,885 discloses a lazy susan assembly having a rotational and vertical adjustment mechanism. The lazy susan includes a shaft supported for rotation about a vertical axis within an L-shaped cabinet. The lazy susan is provided with a rotary catch mechanism which maintains the shaft at a selected rotary position relative to the cabinet. A vertical position of the lazy susan within the cabinet can be adjusted with a shaft height adjustment mechanism which includes a wedge disposed beneath the shaft. The wedge displaces the shaft vertically along the axis upon movement of the wedge either towards or from the shaft. A mounting plate secured to the top wall of the cabinet with conventional fasteners inserted through holes provide the support for the top end of the shaft. The mounting plate includes a frusto-conical portion which converges towards the cabinet interior. The frusto-conical portion forms a hole which receives and provides a bearing for the top of the shaft. This known lazy susan assembly only allows for rotating any shelves supported at the shaft together with the shaft. Thus, two or more shelves supported to the shaft may only be rotated simultaneously. Further, the shaft height adjustment mechanism including the wedge is complex and expensive.

Thus, there still is a need of a less complex and both easily manufactured and easily mounted lazy susan fitting for a cabinet.

SUMMARY OF THE INVENTION

More particularly, the present invention relates to a lazy susan fitting for a cabinet having a body including a top wall and a bottom wall. The lazy susan fitting comprises a supporting column having a top end, a bottom end and a constant length between the top end and the bottom end. The lazy susan fitting further comprises a top mount configured to be fixed to the top wall of the cabinet and to laterally support the top end of the supporting column, and a bottom mount configured to be fixed to the bottom wall of the cabinet and to downwardly and laterally support the bottom end of the supporting column. The lazy susan fitting further comprises at least one shelf mount configured to be mounted to the supporting column at a position located between the top end and the bottom end, and at least one shelf having a central opening configured to be supported at the supporting column via the at least one shelf mount, the supporting column extending through the central opening. The top mount and the top end of the supporting column are configured to allow for mounting the top end of the supporting column to the top mount by moving the top end of the supporting column tilted out of the vertical in the top mount fixed to the top wall from below, for initially moving the top end of the supporting column in the top mount upwards beyond a final installation position, for aligning the supporting column in the top mount to the vertical, and for lowering the top end of the supporting column aligned to the vertical in the top mount into the final installation position. The bottom mount and the bottom end of the supporting column are configured for mounting the bottom end of the supporting column to the bottom mount by inserting the bottom end of the supporting column aligned to the vertical into the bottom mount fixed to the bottom wall from above, when lowering the top end of the supporting column aligned to the vertical in the top mount into the final installation position.

Further, the present invention more particularly relates to a corner cabinet having a body including a top wall, a bottom wall, side walls and an access opening delimited by the top wall, the bottom wall and the side walls, and a lazy susan fitting installed in the body. The lazy susan fitting comprises a supporting column essentially made from one metal tube section and having a top end, a bottom end and a constant length between the top end and the bottom end, a top mount fixed to the top wall of the body and supporting the top end of the supporting column in an installation position in lateral and upward directions, a bottom mount fixed to the bottom wall and supporting the bottom end of the supporting column in lateral, downward and rotational directions, at least one pivot bearing mounted to the supporting column at a position located between the top end and the bottom end, and at least one shelf having a central opening and being supported at the supporting column via the at least one pivot bearing, the supporting column extending through the central opening. The top mount comprises a deactivatable latch, the active latch supporting the top end of the supporting column in the installation position in the top mount in the upward direction, and the deactivated latch allowing for raising the supporting column in the top mount beyond the installation position of its top end such as to disengage the supporting column from the bottom mount. The top mount and the top end of the supporting column are further configured to allow for tilting the raised supporting column out of the vertical and for lowering the tilted supporting column such as to disengage the supporting column from the top mount without re-inserting it into the bottom mount. The at least one shelf and the supporting column disengaged from the bottom mount and the top mount and extending through the central opening of the at least one shelf being configured for being moved together through the access opening out of the corner cabinet.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
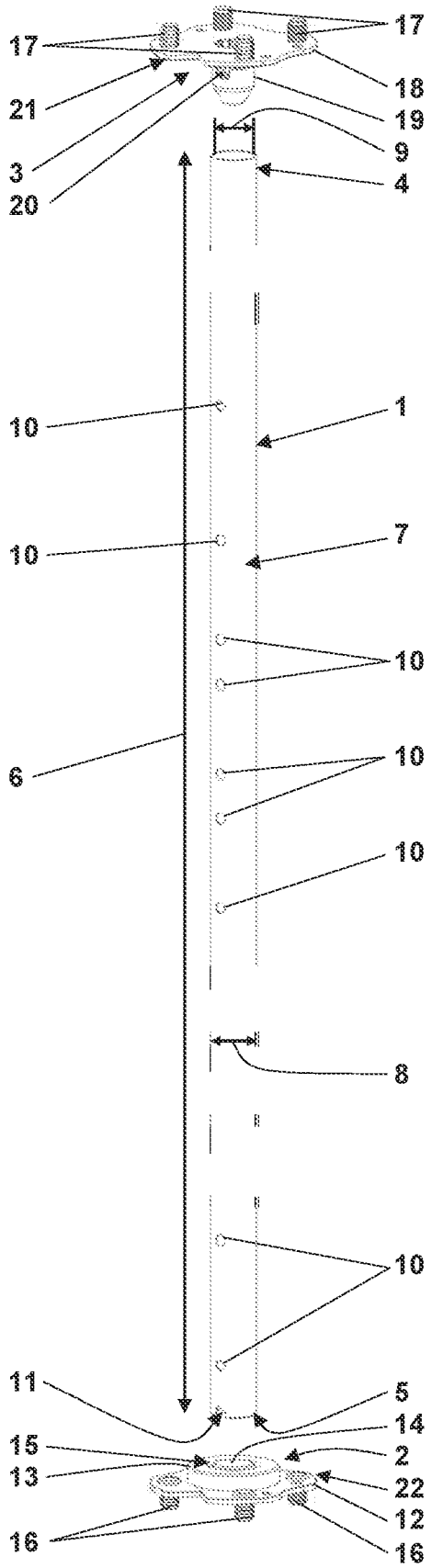
FIG. 1 is an exploded view of a supporting column, a bottom mount and a top mount of first embodiment of a lazy susan fitting according to the invention.

The constant length of the supporting column of the lazy susan fitting according to the present invention allows for easily manufacturing the supporting column. The supporting column may, for example, be essentially made from a single metal tube section. The missing adjustability with regard to the length of the supporting column is compensated for by the configuration of the top mount and the top end of the supporting column. This configuration allows for mounting the tilted supporting column to the top mount and to move the supporting column in the top mount upwards beyond a final installation position. Once moved upwards so high, the supporting column may be aligned to the vertical and then be mounted from above to the bottom mount. The supporting column simultaneously reaches its final installation position in the top mount and its final installation position in the bottom mount. For dismounting the supporting column from the bottom and top mounts the steps may simply be carried out in an reversed order.

Preferably, the top mount comprises a latch configured to stop the top end of the supporting column in the top mount from inadvertently moving upwards out of the final installation position. This latch may be activated once the top end of the supporting column has reached its final installation position from above. For dismounting the supporting column the latch has to be deactivated.

In one embodiment of the lazy susan fitting according to the invention, the latch is a manually deactivatable snap-in latch configured and arranged to snap-in or snap-out, when the top end of the supporting column lowered into the top mount reaches the final installation position. By snapping-in or snapping-out, this latch is automatically activated. However, it has to be deactivated manually for initially moving the top end of the supporting column in the top mount upwards beyond the final installation position.

In one particular embodiment of the lazy susan fitting of the present invention, the top mount essentially consists of a top one-piece shaped body made of plastic and comprising the manually deactivatable snap-in or snap-out latch snapping-in or snapping-out, when the top end of the supporting column lowered in the top mount reaches the final installation position. The top mount made as a one-piece shaped body of plastic can be provided at low cost without compromising the function of the lazy susan fitting according to the present invention.

In one embodiment, the top mount comprises a top stud configured to be inserted into a central hole in the top end of the supporting column, when mounting the top end of the supporting column to the top mount. This top stud may comprise a convex, i.e. a beveled or spherical, supporting surface. If a maximum outer diameter of the convex supporting surface is equal to a minimum inner diameter of the central hole in the top end of the supporting column, the top end is supported at the convex supporting surface without play. Nevertheless, it is possible to move the supporting column upwards in the top mount beyond the final installation position without damaging or even temporarily deforming the top mount.

In another embodiment, the top stud comprises an elastically deformable supporting surface. A maximum outer diameter of the elastically deformable supporting surface should also be essentially equal to a minimum inner diameter of the central hole and the top end of the supporting column to support the supporting column without play. The maximum outer diameter of the elastically deformable supporting surface may also be slightly larger than the minimum inner diameter of the central hole in the top end of the supporting column.

In one embodiment, the top stud of the top mount of the lazy susan fitting according to the present invention comprises an external thread, and the top mount further comprises a stop nut threaded on the external thread and configured to be screwed directly, or via a washer arranged in between, against the top end of the supporting column lowered in the top mount into the final installation position. Thus, the nut may be used to hold the top end of the supporting column in the final installation position. In this embodiment, the nut or the washer may engage into the central hole in the top end of the supporting column to avoid any lateral play, even if the maximum outer diameter of the stud is smaller than the minimum inner diameter of the top end to allow for easily moving the top end in the top mount prior to stopping or blocking it by means of the stop nut.

In one particular embodiment of the lazy susan fitting according to the present invention, the supporting column comprises a single metal tube section extending between the top end and the bottom end of the supporting column. The top end of the supporting column may simply be a top bare end of the metal tube section or it may comprise a top end piece fitted to the metal tube section and defining at least one of an external supporting surface and an internal supporting surface of the top end of the supporting column. Such an end piece may, for example, be advantageous if the external and/or internal diameter of the metal tube section display tolerances. The top end piece may, for example, be made of plastic and press-fitted to the metal tube section.

Instead of or in addition to a top stud, the top mount may comprise a top collar configured to receive the top end of the supporting column, when mounting the top end of the supporting column to the top mount. Whereas the supporting column is supported at the stud via its inner diameter, the supporting column is supported at the collar via its outer diameter.

In one embodiment of the lazy susan fitting according to the present invention, the bottom mount essentially consists of a bottom one-piece shaped body made of plastic. Such a shaped body made of plastic can be provided at a high manufacturing precision at comparatively low cost per unit when produced in high numbers.

In detail, the bottom mount may comprise at least one of a bottom collar configured to receive the bottom end of the supporting column, a bottom stud configured to be inserted into a bottom central hole in the bottom end of the supporting column, and a circular ring channel configured to receive the bottom end of the supporting column, when mounting the bottom end of the supporting column to the bottom mount. Each of the bottom collar, the bottom stud and the circular ring channel may be full or segmented. A segmented bottom collar, bottom stud and circular ring channel, i. e. a bottom collar, bottom stud and circular ring channel without closed or continuous circumferential surface(s), may be provided by or made of ribs vertically projecting from a bottom plate of the bottom mount.

The bottom end of the supporting column may either be a bottom bare end of a metal tube section of the supporting column or it may comprise a bottom end piece press-fitted to the metal tube section and defining at least one of an external supporting surface and an internal supporting surface of the bottom end of the supporting column. In any case, the bottom bare end of the metal tube section or the bottom end piece may comprise a notch configured to receive a key of the bottom mount, when mounting the bottom end of the supporting column to the bottom mount. The key received in the notch blocks rotational movements of the supporting column with regard to the bottom mount about the vertical.

The at least one shelf mount may comprise a pivot bearing including a first bearing part configured to be mounted to the supporting column and a second bearing part configured to be mounted to the at least one shelf in the central opening and allowing for a pivot movement of the second part with regard to the first part about the vertical. The pivot bearing may comprise any details according to the teachings of U.S. Pat. Nos. 8,356,953 and 9,265,342 which are incorporated herein by reference with regard to these details.

The supporting column may comprise at least one cross hole configured for mounting the first bearing part of the pivot bearing to the supporting column. Typically, the supporting column will comprise a plurality of such cross holes to allow for mounting the first bearing part and, thus, the shelf at one of several different heights as desired.

The pivot bearing may have an indexed pivot position, and the at least one shelf may have a non-circular shape adapted to a horizontal cross-section of the cabinet body. The indexed pivot position may particularly be a position in which the at least one shelf does not protrude beyond the access opening of the cabinet body so that a door of the cabinet may be closed. More particularly, the at least one shelf may be a so-called pie cut shelf or ¾ shelf. Further details with regard to this embodiment of the lazy susan fitting of the present invention may be taken from U.S. Pat. Nos. 8,356,953 and 9,265,342 incorporated herein by reference.

In those embodiments of the top mount comprising a latch with a lower stop face stopping the top end of the supporting column in the final installation position, an upper stop finally stopping the top end of the supporting column in the top mount may be arranged at a distance of at least % inch (1.27 cm) above the lower stop face. The distance of at least % inch (1.27 cm) allows for initially moving the top end of the supporting column by at least % inch (1.27 cm) beyond its final installation position. Typically, the distance of the upper stop to the lower stop face is not more than 2 inch (5.08 cm).

The constant length of the supporting column of the lazy susan fitting according to the present invention may be close to an inner height of the cabinet body, i.e. the distance between the bottom wall and the top wall of the cabinet body. However, the constant length of the supporting column has to be shorter than this distance by a measure just allowing for mounting the supporting column to the top mount and the bottom mount according to the present invention. Particularly, the constant length of the supporting column may be by a few tenth of an inch shorter than a nominal inner height of the cabinet between the top wall and the bottom wall minus a minimum vertical height of the top mount between its upper stop and the top wall and minus a maximum vertical height of the bottom mount above the bottom wall.

Now referring in greater detail to the drawings, FIG. 1 is an exploded view of a supporting column 1, a bottom mount 2 and a top mount 3 of an embodiment of the lazy susan fitting according to the present invention. The supporting column 1 has a top end 4, a bottom end 5 and a constant length 6 between the top end 4 and the bottom end 5. The supporting column 1 is made from a metal tube section 7, bare ends of the metal tube section 7 forming the top end 4 and bottom end 5. The metal tube section 7 is of constant outer diameter 8 and inner diameter 9. The supporting column 1 is provided with cross holes 10. Further, a notch 11 is provided in the bottom end 5. The bottom mount 2 comprises a bottom plate 12, a bottom collar 13 protruding upwards from the bottom plate 12 and a bottom stud 14 also protruding upwards from the bottom plate 12. A circular ring channel 15 is formed between the bottom collar 13 and the bottom stud 14. The ring channel 15 is configured to receive the bottom end 5 of the supporting column 1 when inserted into the bottom mount 2 from above. A key (not visible in FIG. 1) is arranged in the circular channel 15 to engage the notch 11 such that the supporting column 1 mounted in the bottom mount 2 is fixed for rotation to the bottom mount 2. Drive-in bolts 16 attached to the bottom plate 12 serve for fixation of the bottom mount 2. Such drive-in bolts 17 are also attached to a top plate 18 of the top mount 3. A top stud 19 protrudes downwards from the top plate 18. The stud 19 is provided with two latches 20, only one of the two latches 20 being visible here. Particular, the top mount 3, except of the drive-in bolts 17, is a one-piece shaped body 21 made of plastic, and the latches 20 are a part of this one-piece shaped body, i.e. manually deactivatable snap-out latches supported at the remainder of the top stud 19 via elastically deformable solid body joints. The function of the top mount 3 will be described further with reference to FIG. 4 ff. The bottom mount 2, except of the drive-in bolts 16, is also a one-piece shaped body 22 made of plastic.

Figure 2:
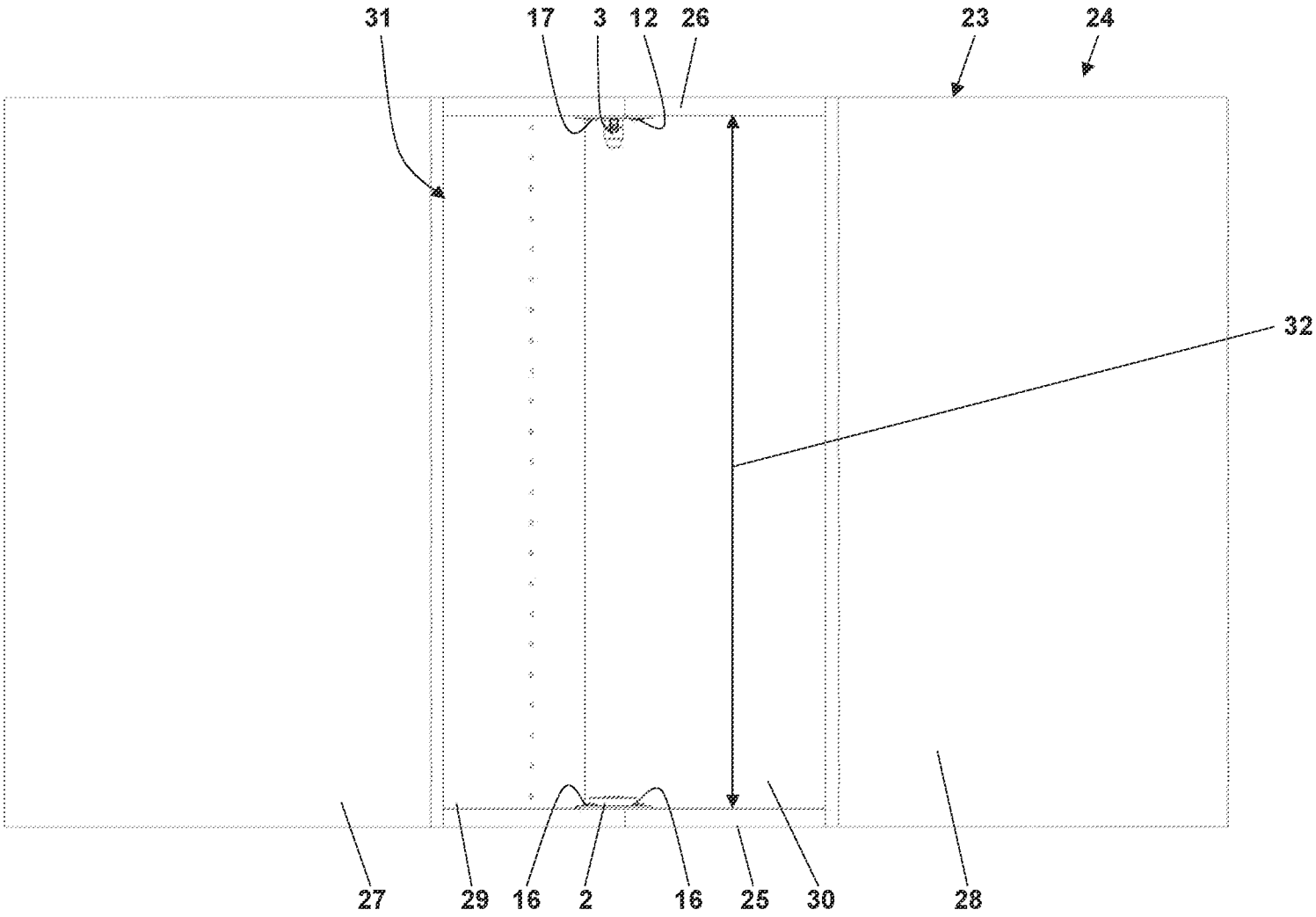
FIG. 2 shows the bottom mount and the top mount according to FIG. 1 fixed to a bottom wall and a top wall of a body of a corner cabinet.

FIG. 2 shows a body 23 of a corner cupboard 24. The body 23 comprises a bottom wall 25, a top wall 26, side walls 27 and 28, and back walls 29 and 30. The bottom wall 25, the top wall 26 and the side walls 27 and 28 delimit an access opening 31. The distance of the top wall 26 to the bottom wall 25 defines an inner height 32 of the body 23. Typically, the access opening 31 can be closed by means of a door which is not depicted here. By means of its drive-in bolts 16, the bottom mount 2 is fixed to the bottom wall 25. Similarly, by means of its drive-in—in bolts 17, the top mount 3 is fixed to the top wall 26 right above the bottom mount 2.

Figure 3:
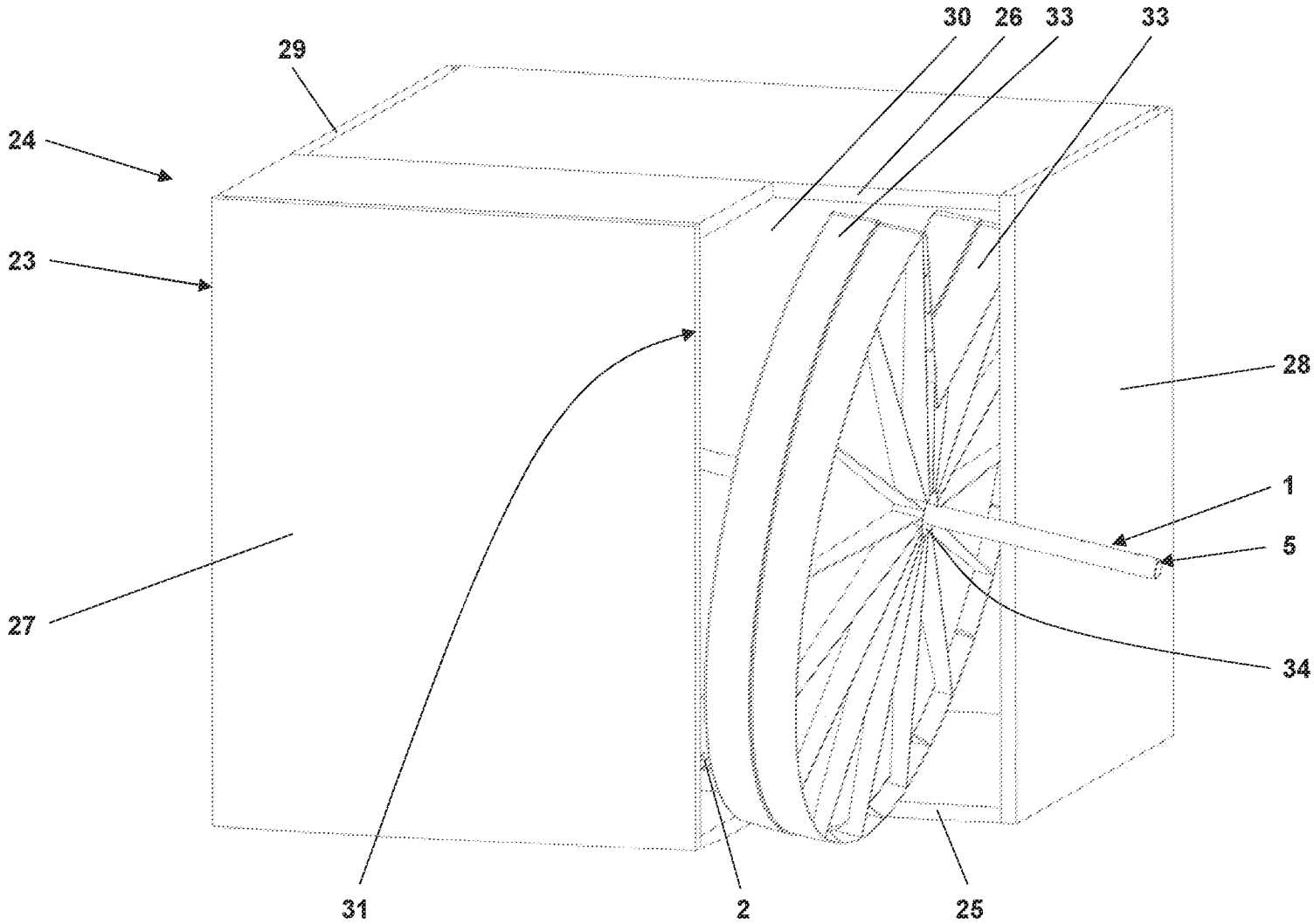
FIG. 3 is a perspective view of the corner cabinet according to FIG. 2 while the supporting column according to FIG. 1 and two shelves arranged on the supporting column are transferred through an access opening into the body of the corner cabinet.

FIG. 3 shows how the supporting column 1 and two pie-cut shelves 33 are moved through the access opening 31 into the body 23 of the corner cabinet 24. Each of the shelves 33 has a central opening 34 through which the supporting column 1 extends. FIG. 3 further shows that both the bottom wall 25 and the top wall 26 may be of two-part construction.

Figure 4:
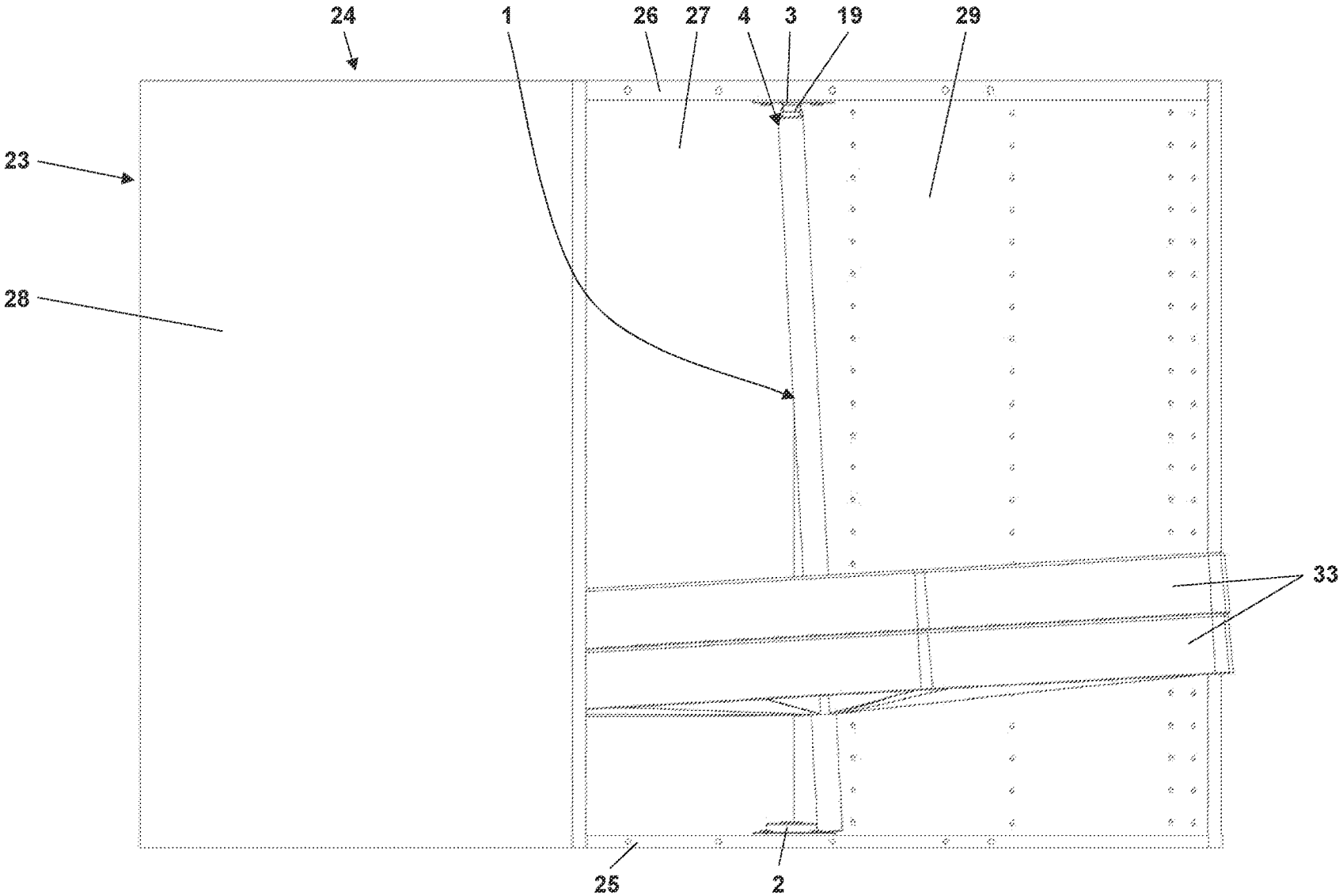
FIG. 4 shows mounting the supporting column with the shelves arranged thereon to the top mount in the body of the corner cabinet.

FIG. 4 is a view into the interior of the body 23 of the corner cabinet 24 through an opening provided by removing the back wall 30 according to FIGS. 2 and 3. The supporting column 1 is already partially mounted to the top mount 3 in that the top end 4 of the supporting column 1 tilted out of the vertical is moved upwards in the top mount 3 fixed to the top wall 26 such that the top stud 19 is inserted into a central hole in the top end 4 of the supporting column 1. The top mount 2 and the top end 4 of the supporting column 1 are configured to allow for this way of mounting the supporting column 1 to the top mount 3.

According to FIG. 5 which is once again a view into the interior of the body 23 of the corner cabinet 24 through the access opening 31, the supporting column 1 has been moved as far as possible upwards in the top mount 3 and the aligned to the vertical such that its bottom end 5 is arranged above the bottom mount 2. The constant length 6 of the supporting column 1 according to FIG. 1 is adapted to the inner height 32 of the body 23 of the corner cabinet 24 to allow for this alignment above the bottom mount 2.

Figure 5:
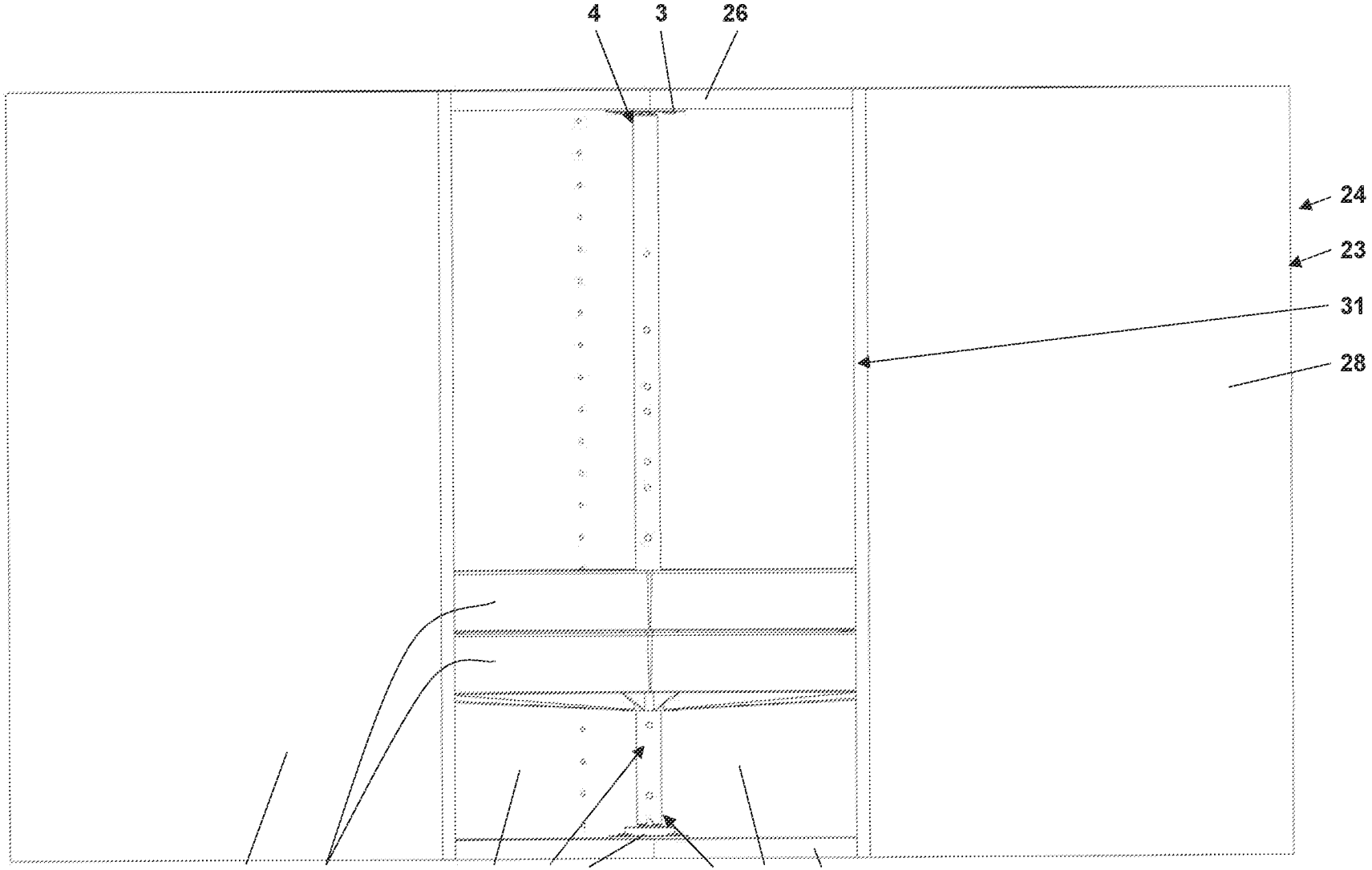
FIG. 5 shows the supporting column mounted to the top mount and aligned to the vertical in the body of the corner cabinet.
Figure 6:
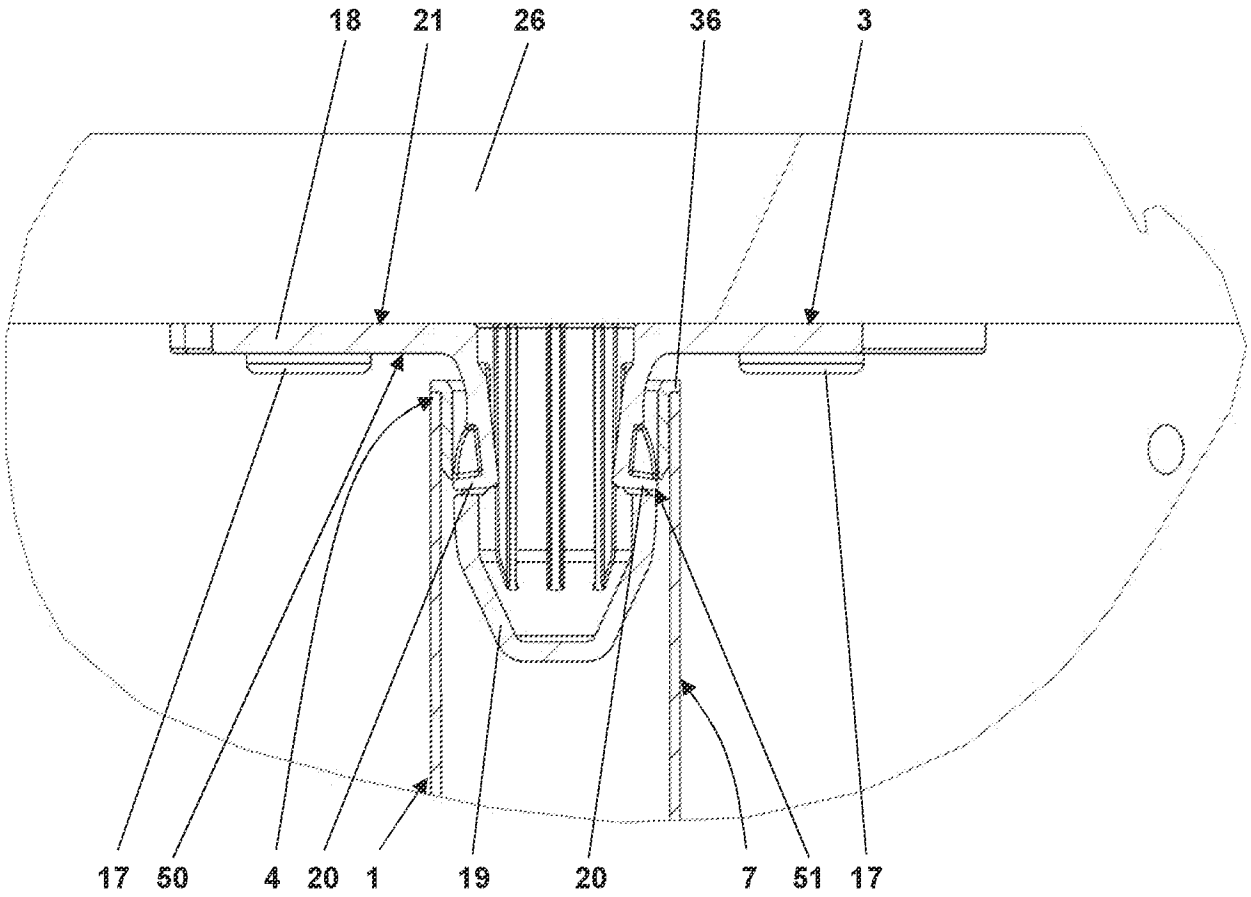
FIG. 6 is a vertical section through the top mount according to FIG. 5.

FIG. 6 is a vertical section through a detail of FIG. 5, i.e. the top mount 3 in which the top end 4 of the supporting column 1 is mounted and moved upwards beyond the latches 20 which had to be deactivated manually to allow for this movement. The top end 4 could be moved a little further upwards than depicted in FIG. 5 before it is stopped by an upper stop 50 provided at the top mount 3. The upper stop 50 is arranged at a distance to lower stop faces 51 of the latches 20.

Figure 7:
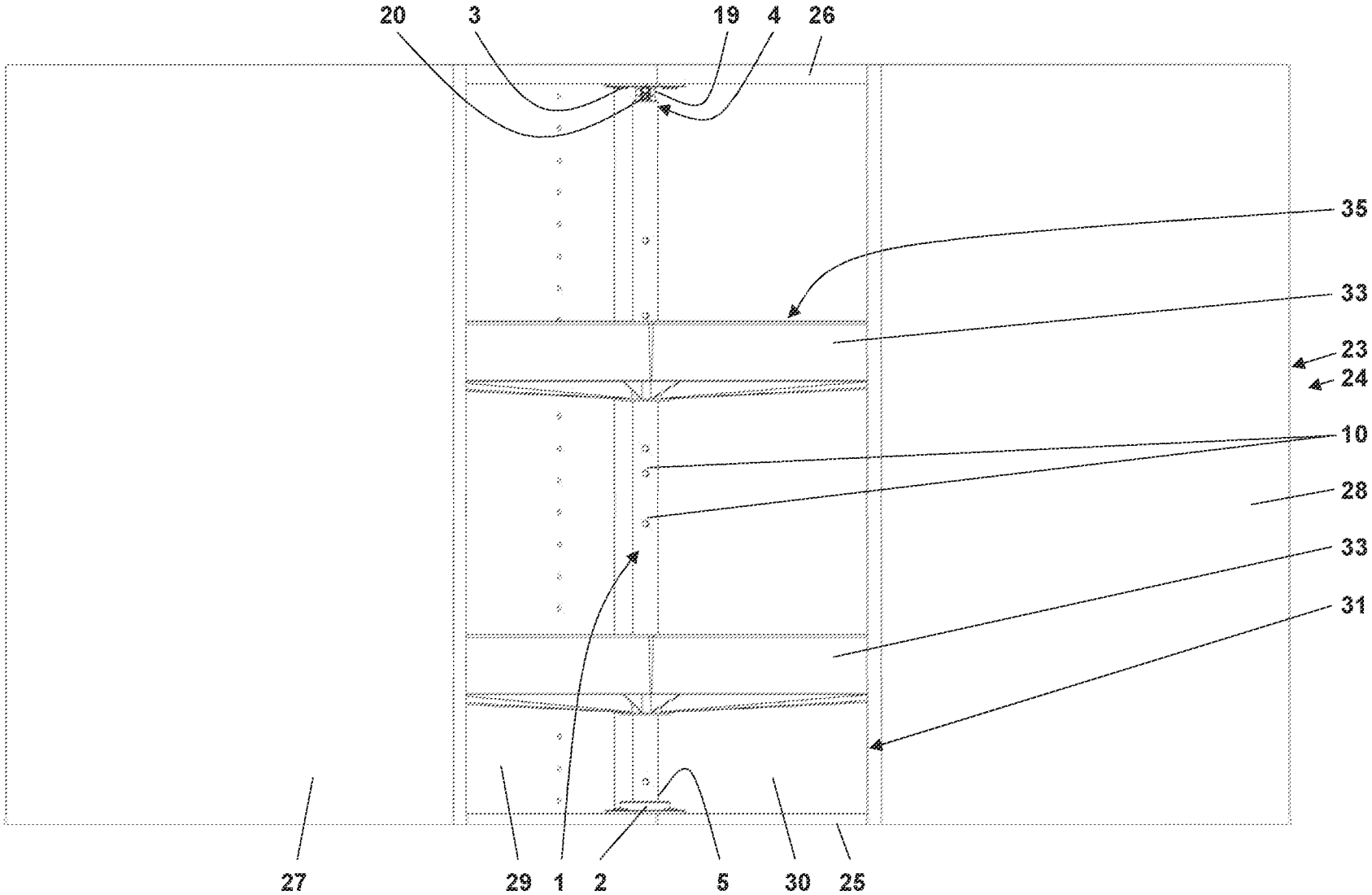
FIG. 7 shows the lazy susan fitting with the supporting column also mounted to the bottom mount in the body of the corner cabinet.

FIG. 7 is a view similar to that one of FIG. 5 of the lazy susan fitting 35 mounted in the body 23 of the corner cabinet 24. As compared to FIG. 5, the supporting column 1 aligned to the vertical has been lowered, and its bottom end 5 has been inserted into the bottom mount 2 fixed to the bottom wall 25. At the same time, the top end 4 of the supporting column 1 has been lowered in the top mount 3 such that it got below the latches 20 which snapped-out above the top end 4 and thus secured the top end 4 in a final installation position in the top mount 3. The shelves 33 have then been mounted to the supporting column 1 at a vertical distance at selected positions located between the top end 4 and the bottom end 5 defined by two of the cross holes 10 (not visible in FIG. 7).

Figure 8:
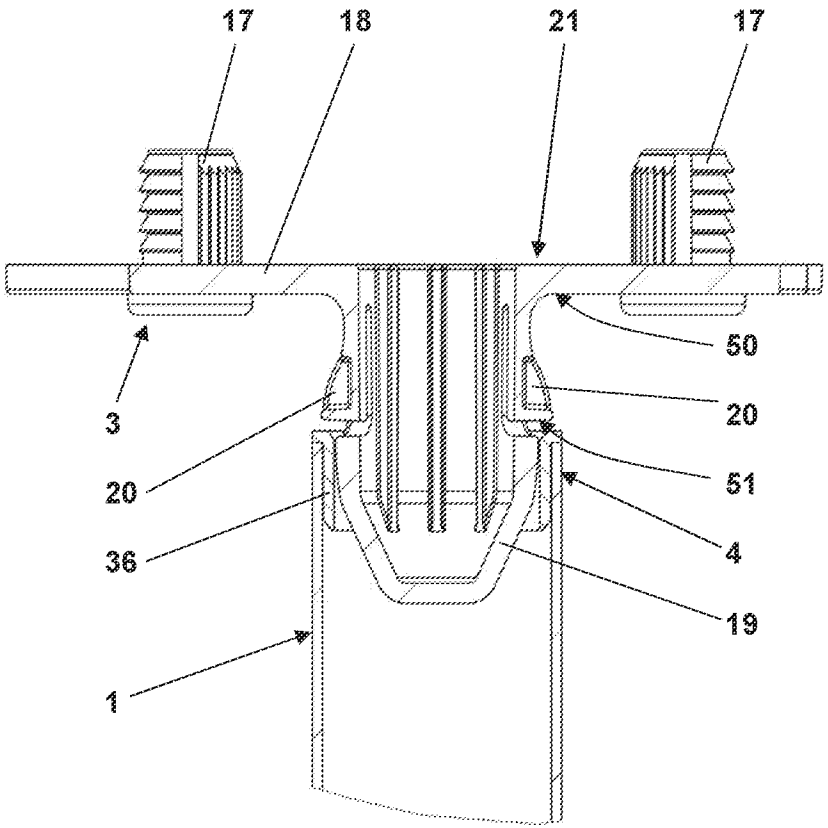
FIG. 8 is a vertical section through the top mount according FIG. 7.

FIG. 8 is an enlarged vertical section through the top mount 3 and the top end 4 of the supporting column 1 according to FIG. 7. In contrast to FIG. 6 the top wall 26 is not shown. More important, however, FIG. 8 shows that the top end 4 is in its final installation position below the latches 20 snapped-out into their active position above the top end 4.

Figure 9:
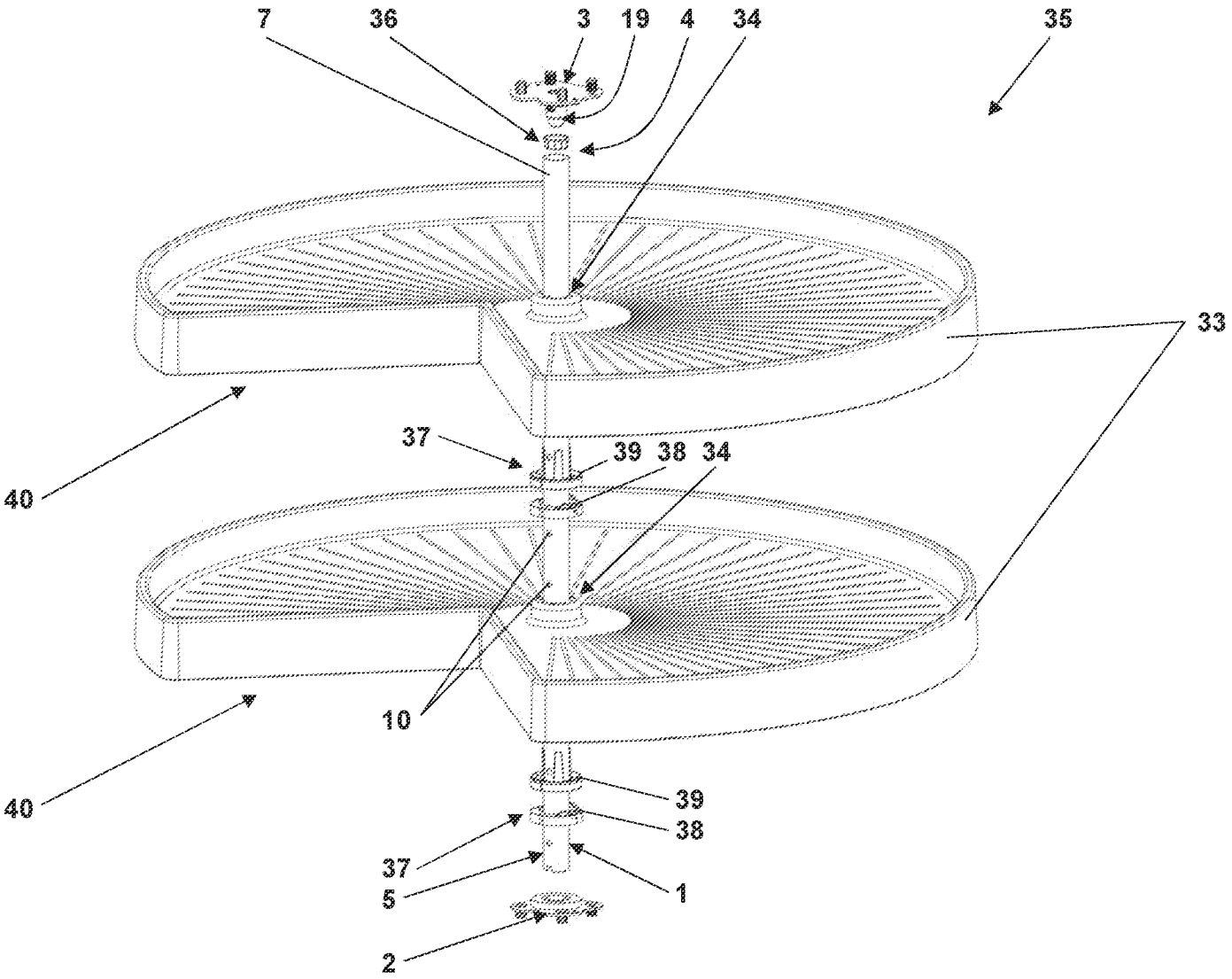
FIG. 9 is a partially exploded view of all parts of a second embodiment of the lazy susan fitting according to the invention.

The partially exploded view of the lazy susan fitting 35 according to FIG. 9 shows some further details. The top end 4 of the supporting column 1 comprises a top end piece 36 which, upon assembly of the supporting column 1, is fitted to the metal tube section 7 and defines an internal supporting surface of the top end 4 of the supporting column 1 via which the top end 4 is supported at the stud 19 of the top mount 3. This top end piece 36 is also shown in FIGS. 6 and 8 but hardly visible there. Further, details of pivot bearings 37 via which the shelves 33 are supported at the supporting column 1 are shown in FIG. 9. The pivot bearing 37 each include a first bearing part 38 mounted to the supporting column 1 via one of the cross holes 10, and a second bearing part 39 to be mounted in the central opening 34 of the respective shelf 33 and allowing for pivot movement of the shelf 33 with regard to the supporting column 1 about the vertical. The pivot bearing is of that kind having an indexed pivot position in which a cut-out 40 of the respective shelf is aligned to the access opening 31 according to FIG. 7 such that the access opening may be closed by a door. For details of such a pivot bearing, see, for example, U.S. Pat. No. 8,356,953 incorporated herein by reference.

Figure 10:
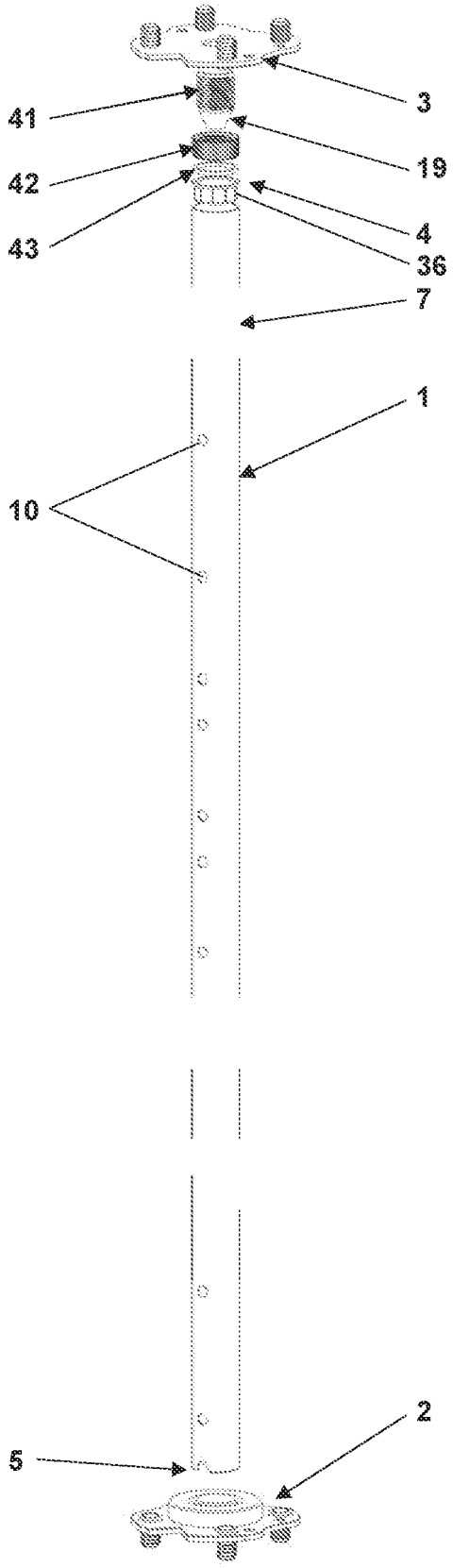
FIG. 10 is an exploded view of the supporting column, the bottom mount and the top mount of a further embodiment of the lazy susan fitting according to the invention.
Figure 11:
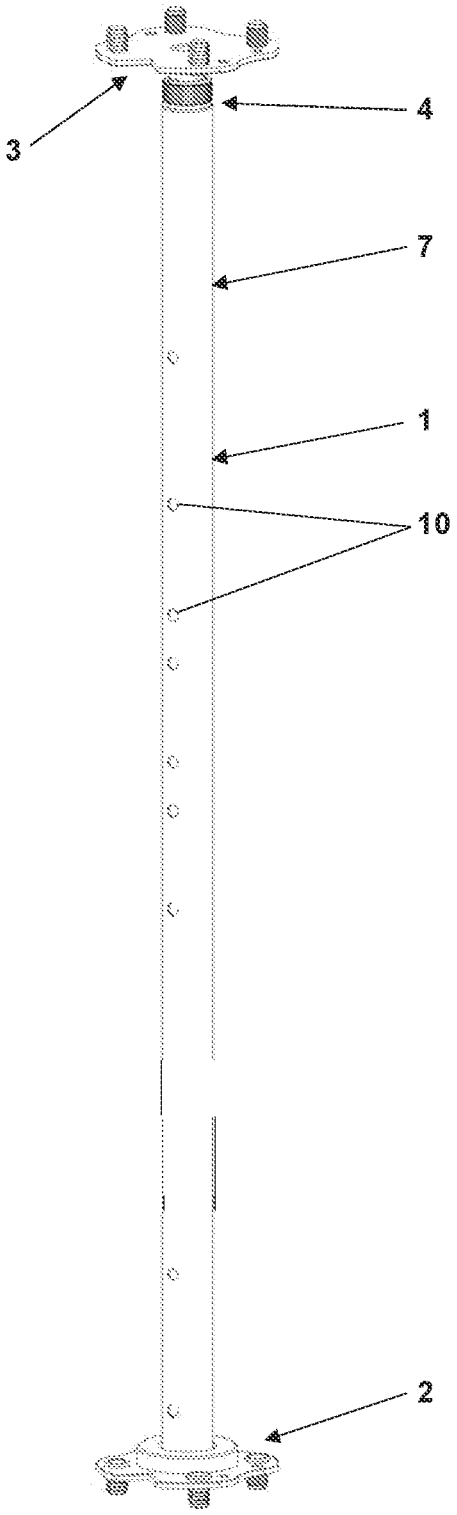
FIG. 11 shows the components of the lazy susan fitting according to FIG. 10 in an assembled state.

FIGS. 10 and 11 show the supporting column 1, the bottom mount 2 and the top mount 3 of another embodiment of the lazy susan fitting according to the present invention. Here, the stud 19 is provided with an external thread 41 and a stop nut 42 screwed thereon. Once the supporting column reaches its final installation position according to FIG. 11, the nut may be screwed down on the top end 4 of the supporting column 1 or on a washer 43 arranged between the stop nut 42 and the top end piece 36. The bottom side of the nut 42 and/or the washer 43 may be contoured such as to engage into the central hole in the top end 4 to remove any play between the top end 4 and the stud 19 which may be helpful to easily insert the stud 19 in the top end 4 when moving the top end 4 in the top mount 3.

Figure 12:
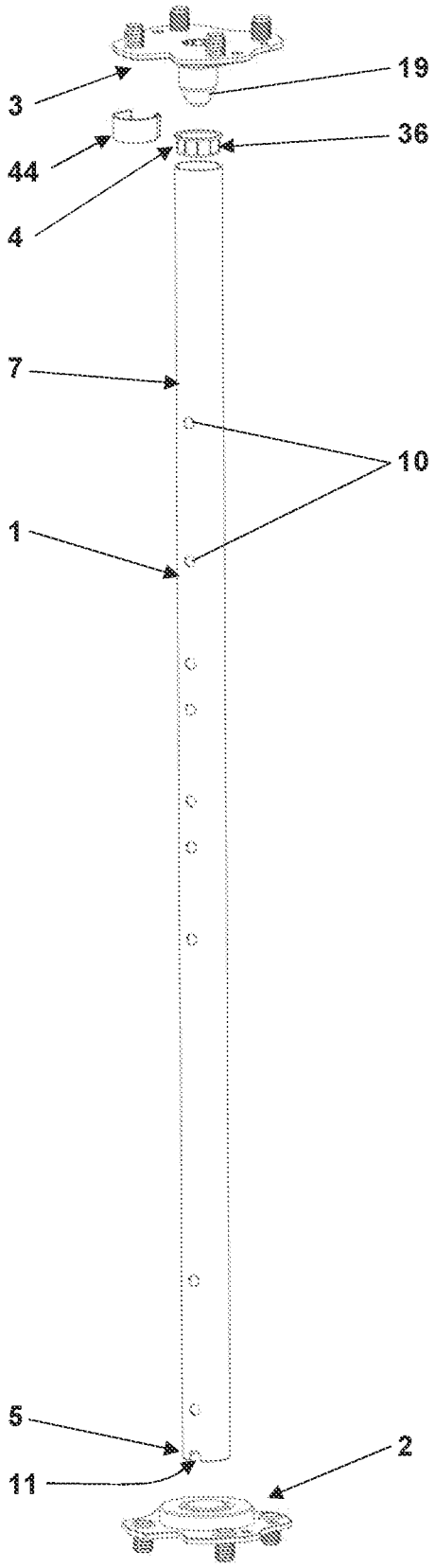
FIG. 12 is an exploded view of the supporting column, the bottom mount and the top mount of a further embodiment of the lazy susan fitting according to the invention.
Figure 13:
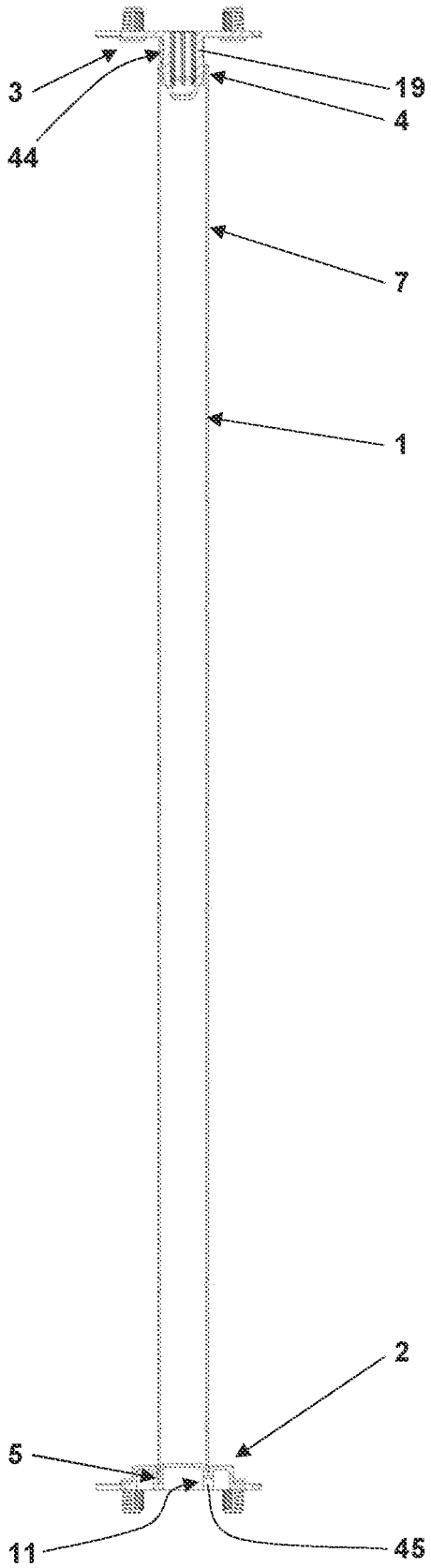
FIG. 13 is a vertical section through the components of the lazy susan fitting according to FIG. 12 in an assembled state.

FIGS. 12 and 13 show the supporting column 1, the bottom mount 2 and the top mount 3 of another embodiment of the lazy susan fitting according to the present invention in an exploded view and in a vertical section. Here, a snap-on ring 44 is provided and snapped onto the top stud 19 once the top end 4 of the supporting column 1 has reached its final installation position. The snap-on ring 44 then stops the supporting column 1 from being moved upwards in the top mount 3. Thus, the supporting column 1 is also held fixed in the bottom mount 2. FIG. 13 additionally indicates how the key 45 engaging the notch 11 fixes the bottom end 5 of the supporting column 1 to the bottom mount 2 in rotational direction about the vertical.

Figure 14:
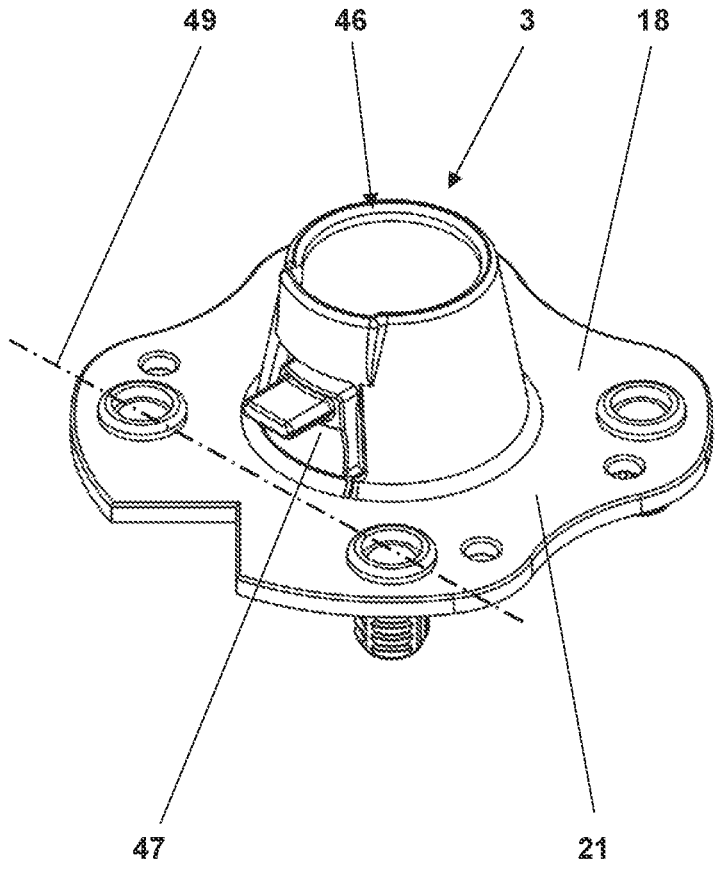
FIG. 14 is a perspective view of a top mount of a further embodiment of the lazy susan fitting according to the invention.
Figure 15:
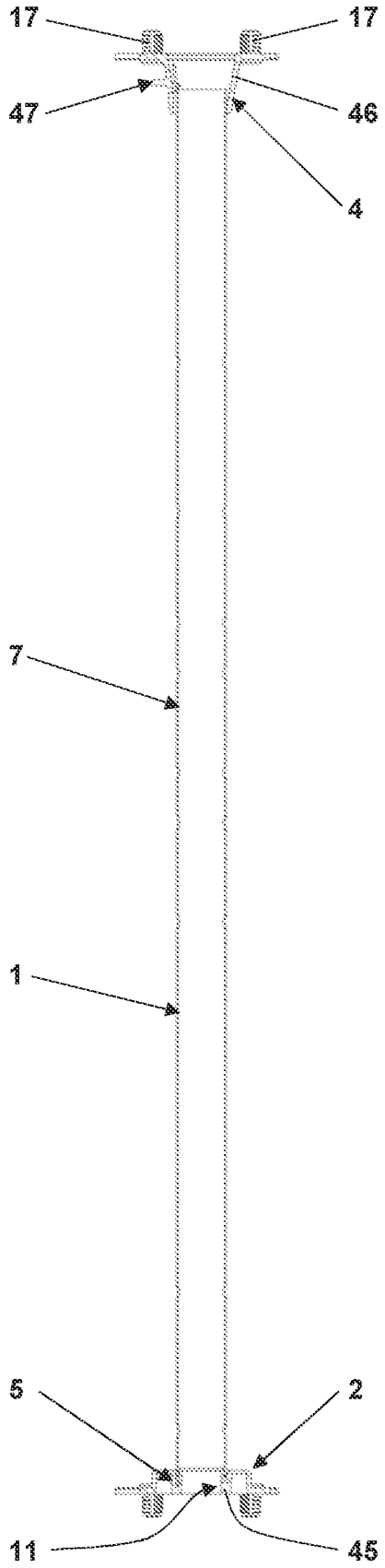
FIG. 15 is a sectional view corresponding to FIG. 13 of the supporting column, the bottom mount and the top mount of an embodiment of the lazy susan fitting according to the invention comprising the top mount according to FIG. 14.

FIG. 14 is a perspective view of a top mount 3 comprising a top collar 46 provided with a manually deactivatable snap-in latch 47. The vertical section according to FIG. 15 shows how the top end 4 of the supporting column, in its final installation position, is located below the snapped-in latch 47 and laterally enclosed by the collar 46.

Figure 16:
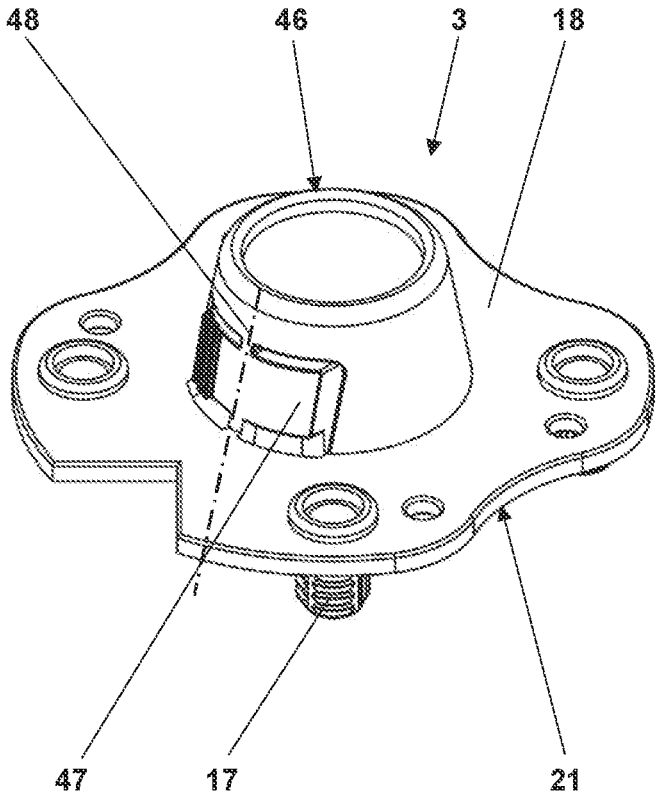
FIG. 16 is a perspective view of a variant of the top mount according to FIG. 14.

FIG. 16 shows another variant of the top mount 3 comprising a collar 46. Here, the snap-in latch 47 is swiveling about a nearly vertical swivel axis 48, whereas the snap-in latch 47 according to FIG. 4 is swiveling about a horizontal axis 49.

Figure 17:
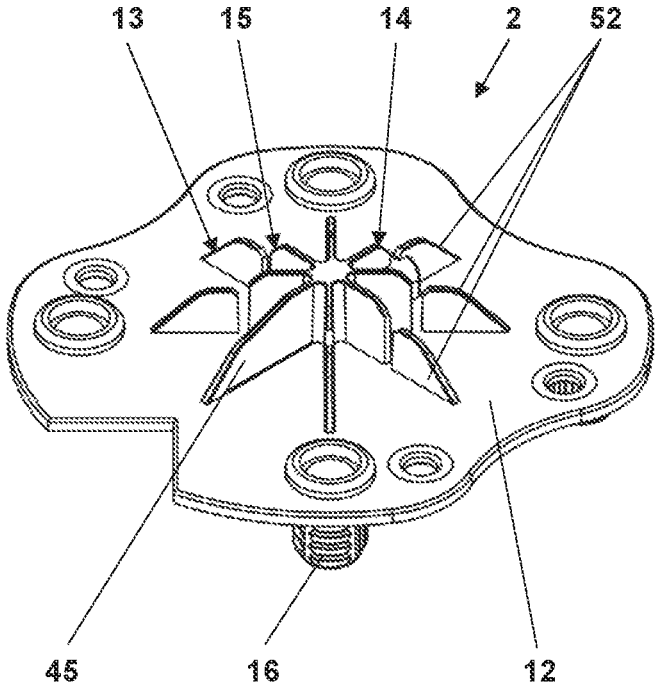
FIG. 17 is a perspective view of another embodiment of the bottom mount than depicted in the preceding Figs.
Figure 18:
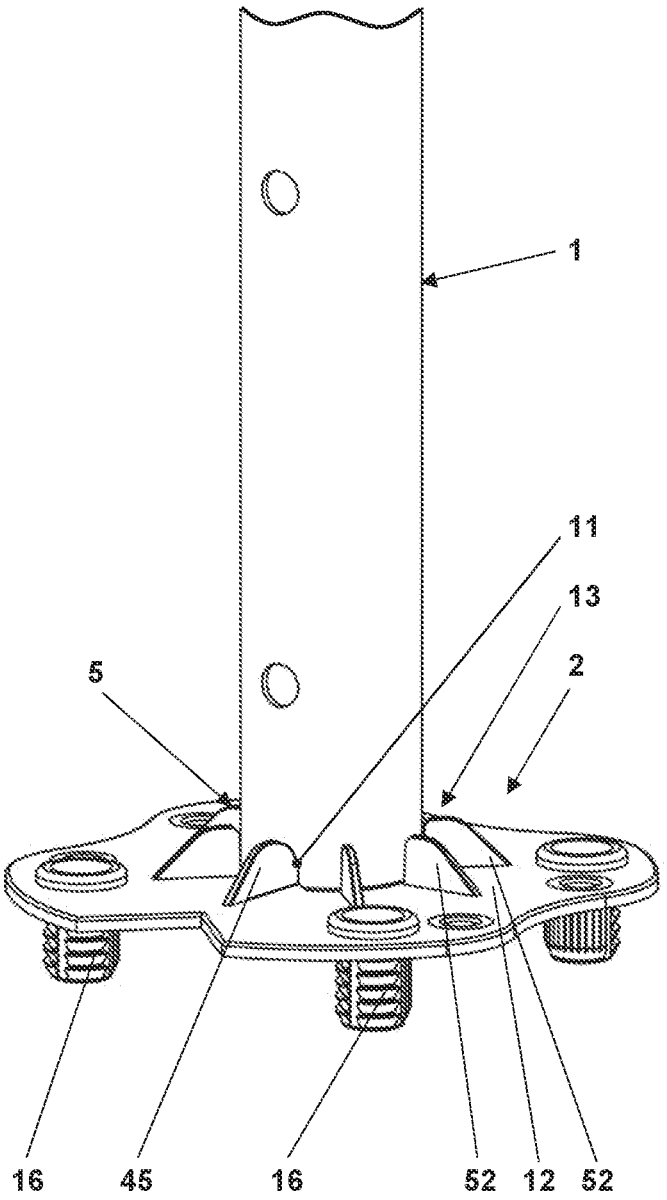
FIG. 18 is another perspective view of the embodiment of the bottom mount according to FIG. 17 with the lower end of the supporting column mounted thereto.

FIG. 17 shows another embodiment of the bottom mount 2 in which rips 52 vertically project from the base plate 12. These rips 52, which are arranged in a star-configuration here, provide the bottom collar 13 as a segmented bottom collar, the bottom stud 14 as a segmented bottom stud 14 and the circular ring channel 15 as a segmented circular ring channel 15. At the same time, one of the rips serves as the key 45 for engaging the notch 11 at the bottom end 5 of the supporting column 1, see FIG. 18.

Figure 19:
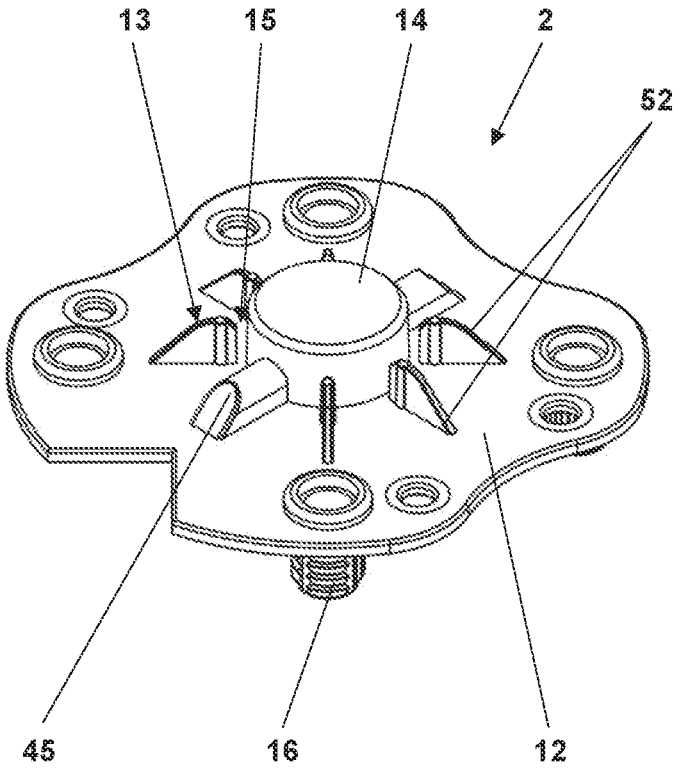
FIG. 19 is a perspective view of a further embodiment of the bottom mount.
Figure 20:
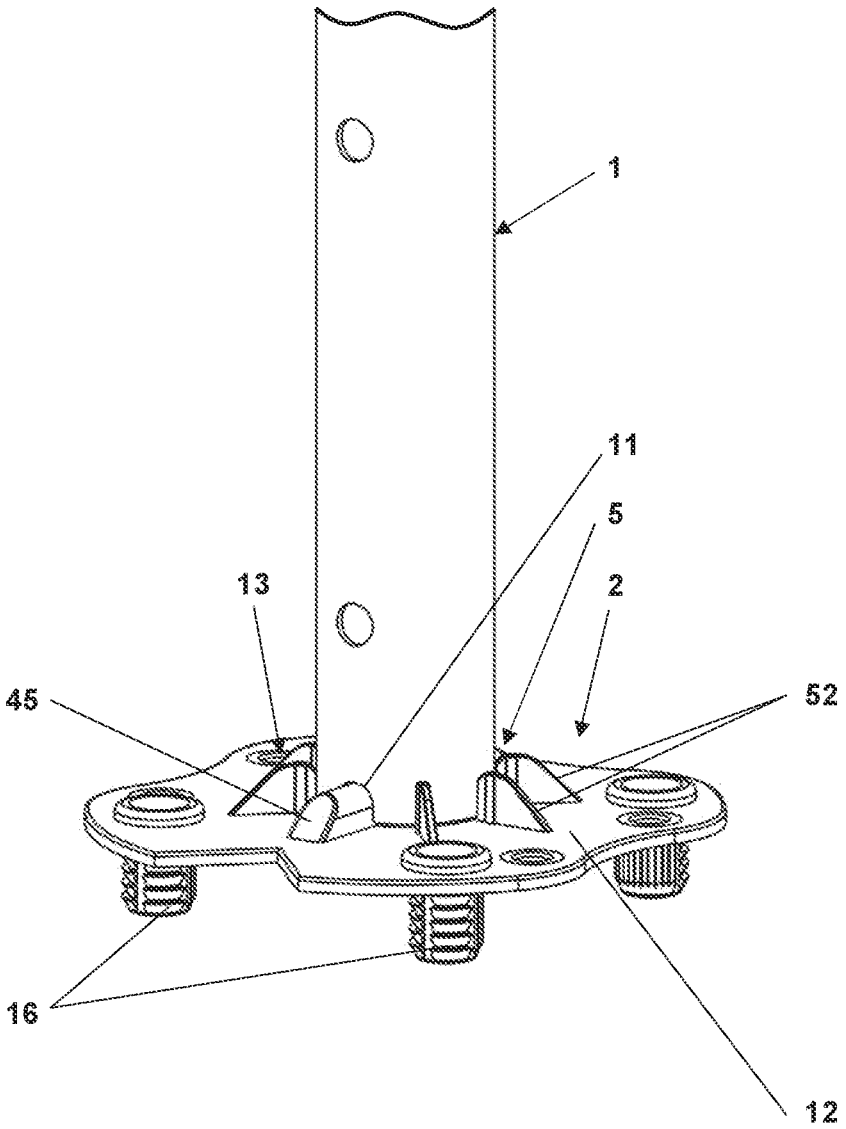
FIG. 20 is another perspective view of the embodiment of the bottom mount according to FIG. 19 with the lower end of the supporting column mounted thereto.

FIG. 19 shows a further embodiment of the bottom mount 2. Here, only the bottom collar 13 and the ring channel 15 are segmented, whereas the bottom stud 14 is a full stud with a closed circumferential surface. FIG. 20 shows the bottom end 5 of the supporting column 1 mounted to the bottom mount 2 according to FIG. 19. Here, one of the rips 52 providing the segmented bottom collar serves as the key 45 engaging the notch 11.

Figure 21:
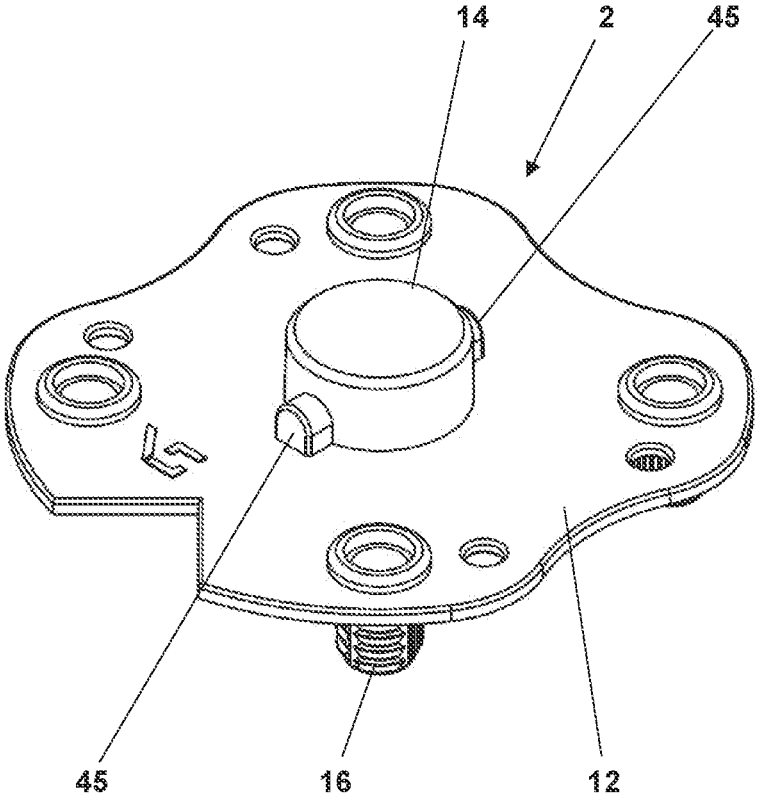
FIG. 21 is a perspective view of an even further embodiment of the bottom mount.
Figure 22:
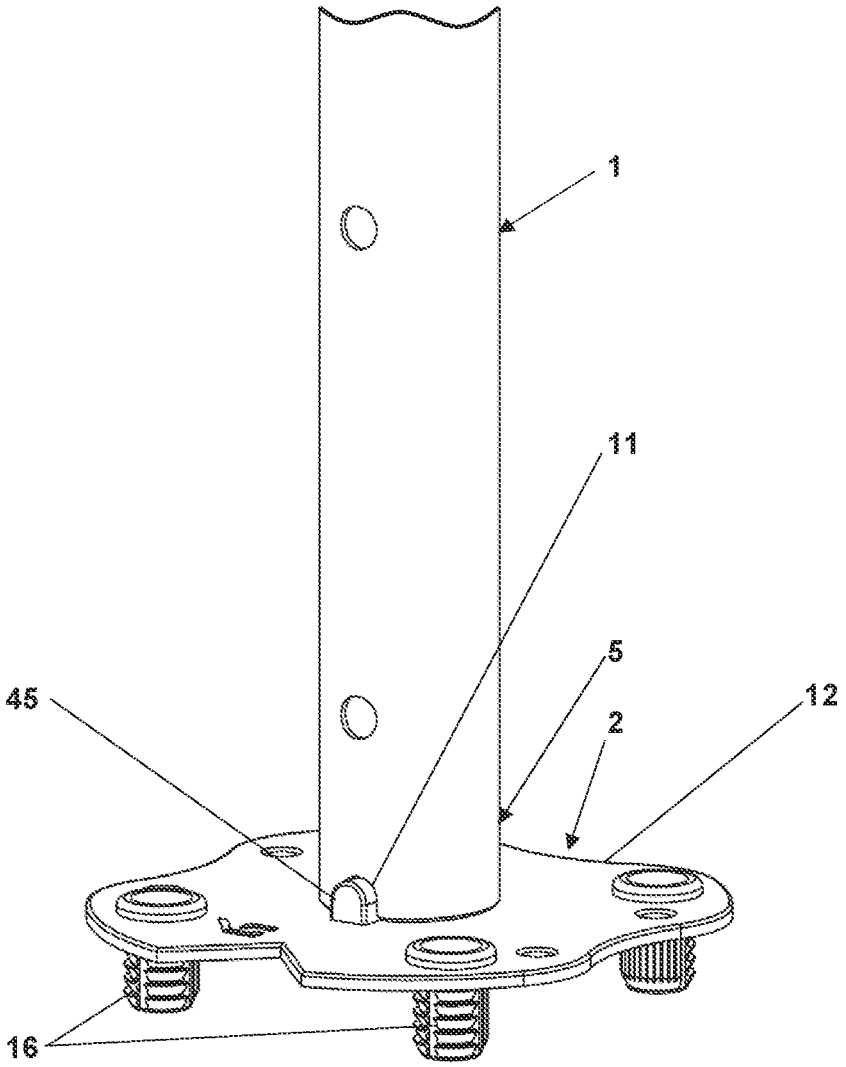
FIG. 22 is another perspective view of the embodiment of the bottom mount according to FIG. 21 with the lower end of the supporting column mounted thereto.

FIG. 21 shows an even further embodiment of the bottom mount 2. Here, only the bottom stud 14 being a full stud and two keys 45 protruding from the closed circumferential surface of the bottom stud 14 in opposite lateral directions vertically project from the base plate 12. FIG. 22 shows the bottom end 5 of the supporting column 1 mounted to the bottom mount 2 according to FIG. 21. Here, only one of the keys 45 engaging one of two notches 11 in the bottom end 5 of the supporting column 1 is visible. In this embodiment of the bottom mount 2, the bottom end 5 of the supporting column 1 is supported in lateral directions at the bottom stud 14 via its inner circumference abutting against the closed circumferential surface of the bottom stud 14.

Many variations and modifications may be made to the preferred embodiments of the invention without departing substantially from the spirit and principles of the invention.

All such modifications and variations are intended to be included herein within the scope of the present invention, as defined by the following claims.

I claim:

1. A lazy susan fitting for a cabinet having a body including a top wall and a bottom wall, the lazy susan fitting comprising:

a supporting column having a top end, a bottom end and a constant length between the top end and the bottom end, a top mount configured to be fixed to the top wall and to laterally support the top end of the supporting column, a bottom mount configured to be fixed to the bottom wall and to downwardly and laterally support the bottom end of the supporting column, at least one shelf mount configured to be mounted to the supporting column at a position located between the top end and the bottom end, and at least one shelf having a central opening configured to be supported at the supporting column via the at least one shelf mount, the supporting column extending through the central opening, wherein the top mount and the top end of the supporting column are configured to allow for mounting the top end of the supporting column to the top mount by moving the top end of the supporting column tilted out of the vertical in the top mount fixed to the top wall from below, for initially moving the top end of the supporting column in the top mount upwards beyond a final installation position, for aligning the supporting column in the top mount to the vertical, and for lowering the top end of the supporting column aligned to the vertical in the top mount into the final installation position, and wherein the bottom mount and the bottom end of the supporting column are configured for mounting the bottom end of the supporting column to the bottom mount by inserting the bottom end of the supporting column aligned to the vertical into the bottom mount fixed to the bottom wall from above, when lowering the top end of the supporting column aligned to the vertical in the top mount into the final installation position, wherein the top mount comprises a latch configured to stop the top end of the supporting column in the top mount from inadvertently moving upwards out of the final installation position, and wherein the latch is a manually deactivatable snap-in or snap-out latch configured and arranged to be automatically activated by snapping-in or snapping-out, when the top end of the supporting column lowered in the top mount reaches the final installation position.

2. The lazy susan fitting of claim 1, wherein the top mount essentially consists of a top one-piece shaped body made of plastic and comprising the manually deactivatable snap-in or snap-out latch.

3. The lazy susan fitting of claim 1, wherein the top mount comprises a top stud configured to be inserted into a central hole in the top end of the supporting column, when mounting the top end of the supporting column to the top mount.

4. The lazy susan fitting of claim 3, wherein the top stud comprises a convex supporting surface, a maximum outer diameter of the convex supporting surface being essentially equal to a minimum inner diameter of the central hole in the top end of the supporting column.

5. The lazy susan fitting of claim 3, wherein the top stud comprises an elastically deformable supporting surface, a maximum outer diameter of the elastically deformable supporting surface being essentially equal to a minimum inner diameter of the central hole in the top end of the supporting column.

6. The lazy susan fitting of claim 1, wherein the supporting column comprises a single metal tube section extending between the top end and the bottom end.

7. The lazy susan fitting of claim 6, wherein the top end of the supporting column is a top bare end of the metal tube section or comprises a top end piece fitted to the metal tube section and defining at least one of an external supporting surface and an internal supporting surface of the top end of the supporting column.

8. The lazy susan fitting of claim 1, wherein the bottom mount essentially consists of a bottom one-piece shaped body made of plastic.

9. The lazy susan fitting of claim 1, wherein the bottom mount comprises at least one of a full or segmented bottom collar configured to receive the bottom end of the supporting column, when mounting the bottom end of the supporting column to the bottom mount, a full or segmented bottom stud configured to be inserted into a bottom central hole in the bottom end of the supporting column, when mounting the bottom end of the supporting column to the bottom mount, and a full or segmented circular ring channel configured to receive the bottom end of the supporting column, when mounting the bottom end of the supporting column to the bottom mount.

10. The lazy susan fitting of claim 1, wherein the at least one shelf mount comprises a pivot bearing including a first bearing part configured to be mounted to the supporting column and a second bearing part configured to be mounted to the at least one shelf in the central opening and allowing for a pivot movement of the at least one shelf with regard to the supporting column about the vertical.

11. The lazy susan fitting of claim 10, wherein the supporting column comprises at least one cross hole configured for mounting the first bearing part to the supporting column.

12. The lazy susan fitting of claim 10, wherein the pivot bearing has an indexed pivot position, and wherein the at least one shelf has a non-circular shape adapted to a horizontal cross-section of the cabinet body.

13. A lazy susan fitting for a cabinet having a body including a top wall and a bottom wall, the lazy susan fitting comprising:

a supporting column having a top end, a bottom end and a constant length between the top end and the bottom end, a top mount configured to be fixed to the top wall and to laterally support the top end of the supporting column, a bottom mount configured to be fixed to the bottom wall and to downwardly and laterally support the bottom end of the supporting column, at least one shelf mount configured to be mounted to the supporting column at a position located between the top end and the bottom end, and at least one shelf having a central opening configured to be supported at the supporting column via the at least one shelf mount, the supporting column extending through the central opening, wherein the top mount and the top end of the supporting column are configured to allow for mounting the top end of the supporting column to the top mount by moving the top end of the supporting column tilted out of the vertical in the top mount fixed to the top wall from below, for initially moving the top end of the supporting column in the top mount upwards beyond a final installation position, for aligning the supporting column in the top mount to the vertical, and for lowering the top end of the supporting column aligned to the vertical in the top mount into the final installation position, and wherein the bottom mount and the bottom end of the supporting column are configured for mounting the bottom end of the supporting column to the bottom mount by inserting the bottom end of the supporting column aligned to the vertical into the bottom mount fixed to the bottom wall from above, when lowering the top end of the supporting column aligned to the vertical in the top mount into the final installation position, wherein the supporting column comprises a single metal tube section extending between the top end and the bottom end, wherein the bottom end of the supporting column is a bottom bare end of the metal tube section, and wherein the bottom bare end of the metal tube section comprises a notch configured to receive a key of the bottom mount, when mounting the bottom end of the supporting column to the bottom mount for blocking rotational movements of the supporting column with regard to the bottom mount about the vertical.

14. A lazy susan fitting for a cabinet having a body including a top wall and a bottom wall, the lazy susan fitting comprising:

a supporting column having a top end, a bottom end and a constant length between the top end and the bottom end, a top mount configured to be fixed to the top wall and to laterally support the top end of the supporting column, a bottom mount configured to be fixed to the bottom wall and to downwardly and laterally support the bottom end of the supporting column, at least one shelf mount configured to be mounted to the supporting column at a position located between the top end and the bottom end, and at least one shelf having a central opening configured to be supported at the supporting column via the at least one shelf mount, the supporting column extending through the central opening, wherein the top mount and the top end of the supporting column are configured to allow for mounting the top end of the supporting column to the top mount by moving the top end of the supporting column tilted out of the vertical in the top mount fixed to the top wall from below, for initially moving the top end of the supporting column in the top mount upwards beyond a final installation position, for aligning the supporting column in the top mount to the vertical, and for lowering the top end of the supporting column aligned to the vertical in the top mount into the final installation position, and wherein the bottom mount and the bottom end of the supporting column are configured for mounting the bottom end of the supporting column to the bottom mount by inserting the bottom end of the supporting column aligned to the vertical into the bottom mount fixed to the bottom wall from above, when lowering the top end of the supporting column aligned to the vertical in the top mount into the final installation position, wherein the top mount comprises a latch having a lower stop face stopping the top end of the supporting column in the final installation position, and an upper stop arranged at a distance of at least ½ inch (1.27 cm) above the lower stop face and finally stopping the top end of the supporting column when initially being moved beyond the final installation position.

* * * * *